United States Patent [19]

Marseillan

[11] 4,077,598

[45] Mar. 7, 1978

[54] MEANS FOR MOLDING A ROOF OR FLOOR SLAB

[76] Inventor: Jorge Marseillan, Sarmiento 440, Buenos Aires, Argentina

[21] Appl. No.: 730,467

[22] Filed: Oct. 7, 1976

[30] Foreign Application Priority Data

Oct. 7, 1975 Argentina ..... 260721

[51] Int. Cl.[2] ..... E04G 11/46

[52] U.S. Cl. ..... 249/19; 249/18; 249/32; 249/192

[58] Field of Search ..... 249/18, 19, 23, 30–32, 249/189, 192, 176, 177; 52/588

[56] References Cited

U.S. PATENT DOCUMENTS

| | | | |
|---|---|---|---|
| 745,000 | 11/1903 | Coffield | 52/588 |
| 1,147,378 | 7/1915 | Cronkhite | 52/588 |
| 2,801,454 | 8/1957 | Troiel | 249/189 |
| 3,072,996 | 1/1963 | McGuire | 249/19 |

FOREIGN PATENT DOCUMENTS

| | | | |
|---|---|---|---|
| 1,070,036 | 5/1967 | United Kingdom | 249/192 |

*Primary Examiner*—Francis S. Husar
*Assistant Examiner*—John McQuade
*Attorney, Agent, or Firm*—Fitzpatrick, Cella, Harper & Scinto

[57] ABSTRACT

A form for moulding a roof or intermediate floor slab for a substantially rectangular enclosure, the form comprising a plurality of substantially rectangular panels each defining a flat substantially rectangular moulding surface, the panels being designed so that they can be arranged and supported in chessboard array to define a substantially flat continuous moulding surface extending over said enclosure, said array being supported by an edge secured to the walls of the enclosure or to the form for casting these walls.

9 Claims, 8 Drawing Figures

Fig. 1
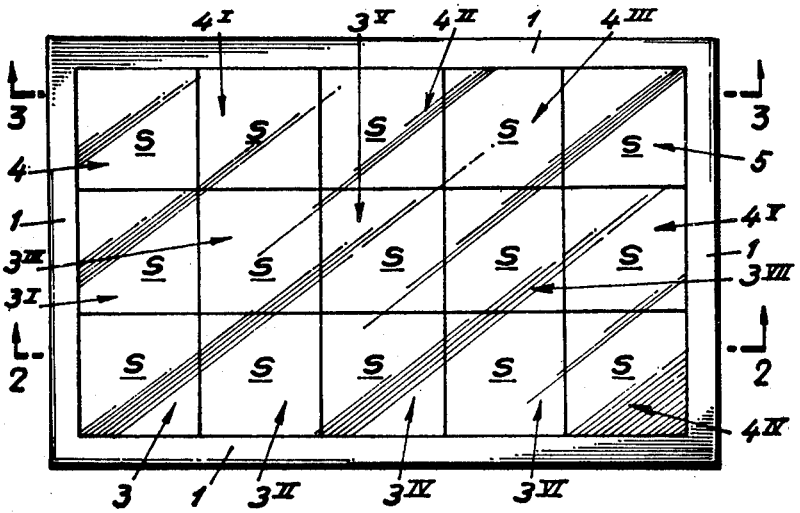
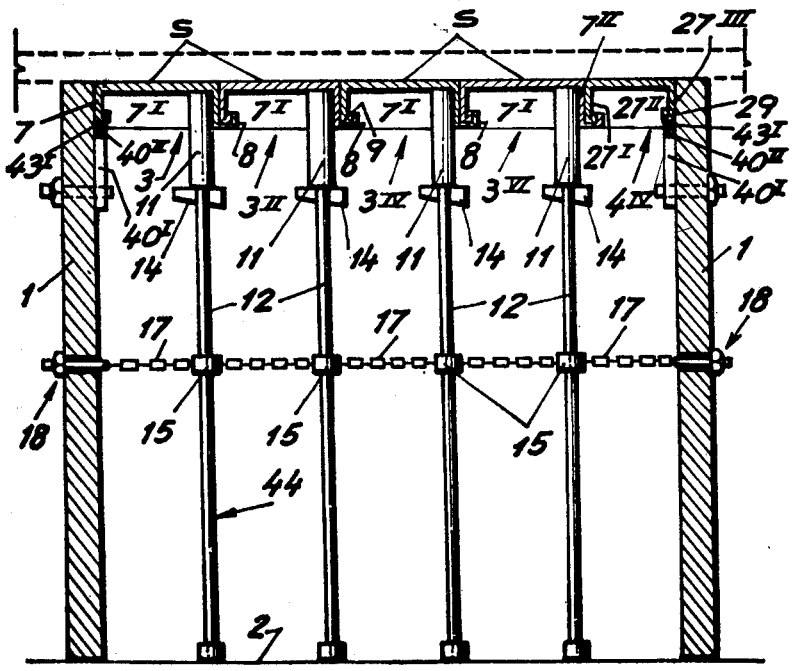
Fig. 2

Fig. 3
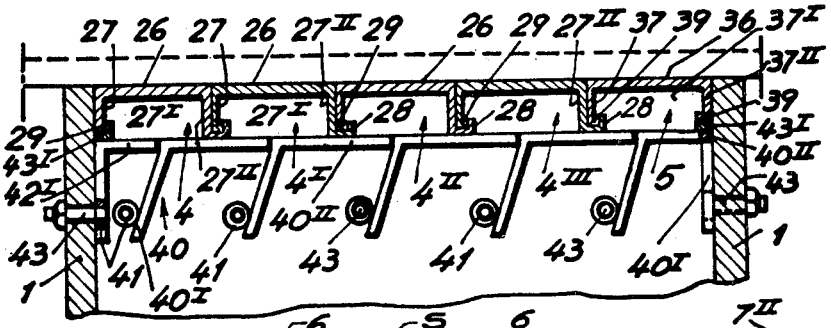
Fig. 5
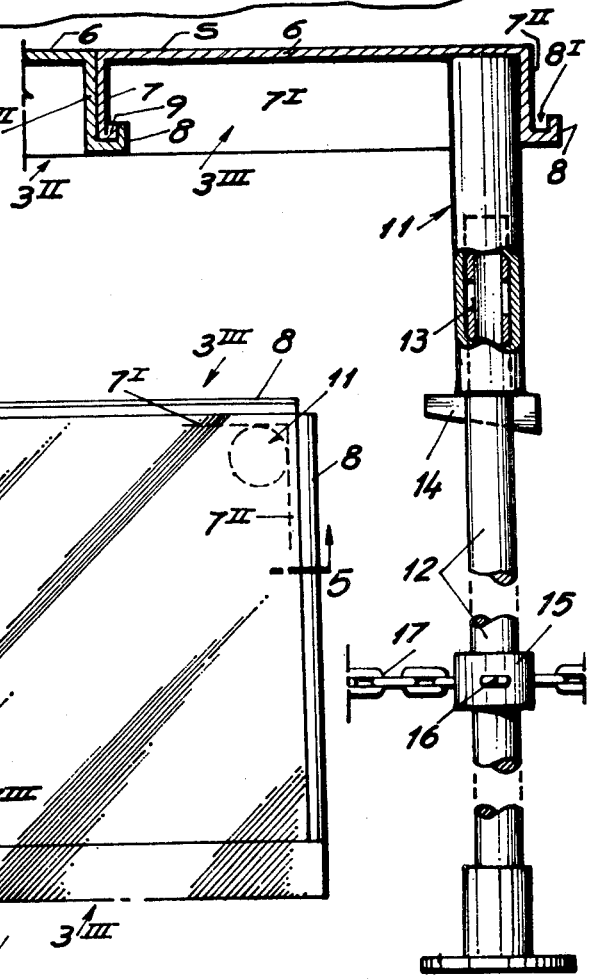
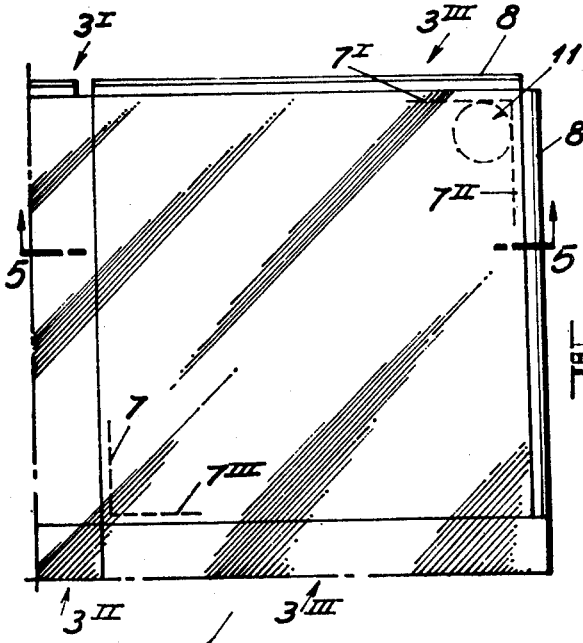
Fig. 4

Fig. 6
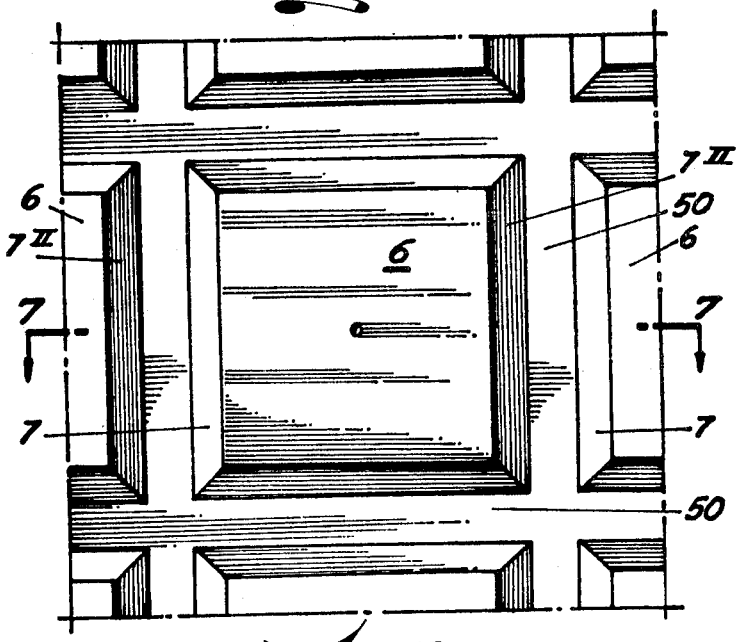
Fig. 7
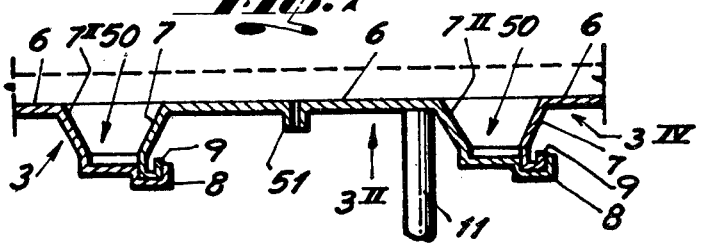
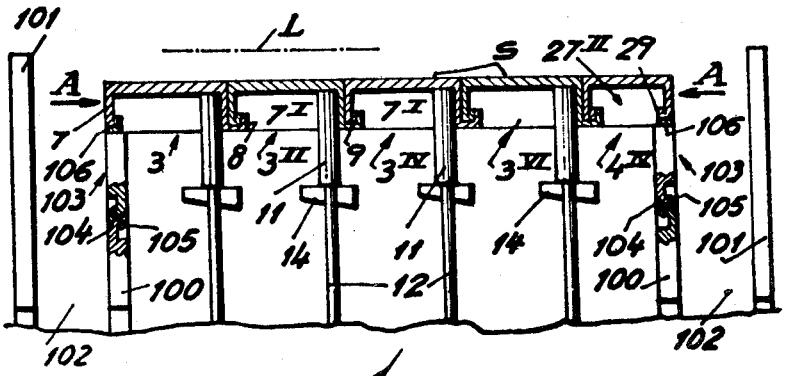
Fig. 8

MEANS FOR MOLDING A ROOF OR FLOOR SLAB

BACKGROUND OF THE INVENTION

The present invention relates to forms for cement slabs and the like, for in situ molding a roof slab or intermediate floor slab.

Roof slabs, floor slabs as well as other flat horizontal parts of buildings can have any of a wide variety of sizes and shapes. It is for this reason that the forms originally conceived for moulding such slabs had to be versatile and therefore they were made up of narrow planks of wood secured one to another. The forms erected in this manner required the skill of a carpenter.

Modern building techniques rely on the use of large panels, which are supported in a horizontal position, for in situ moulding roof slabs or intermediate floor slabs, because each storey in a given building is merely a repetition of a previous storey. These panels replace the individual planks of wood which were secured together and to a vertical support so as to form a horizontal flat moulding surface onto which the cement was then poured.

The use of large panels has become widely spread in spite of their high cost because they afford the possibility of being used for moulding the floor slabs or roof slabs of a multiple storey building, without having to dismantle and assemble the wooden moulding structures floor by floor. Although these panels also have to be erected and brought down before and after each storey is cast, they are simple to operate thus reducing site personnel. These panels are generally made of metal and they are held in place by struts of variable length which are made to rest upon a previously moulded lower floor. Although these panels represent an advancement in the art, they are heavy and awkard and therefore they can only be mounted in place by an army of workmen or by the use of cranes.

It is the aim of the present invention to provide a form for moulding a roof slab or an intermediate floor slab, in situ, which is just as versatile as the original planks of wood but which is just as simple and easy to assemble as a large panel but which is lighter and easier to handle whereby the assembly of a form can be effected by one man, without skill and without the need of cranes. The simplified form which can be obtained by following the teachings of the present invention is basically for use in buildings of regular dimensions and shapes. In this connection, it is felt that the present invention is particularly useful for erecting groups of buildings or houses of uniform characteristics.

According to the present invention, the new form can be assembled by mounting it either on an already moulded or erected wall or on the form to be used to mould the walls of the enclosure.

For example, the form of the present invention can be used in combination with the form described in my copending patent application Ser. No. 676,613 filed on Apr. 13th., 1976 wherein I disclose a form for building walls and the like. In this case the walls and roof of an enclosure can be moulded or cast simultaneously.

The form of the present invention basically comprises a plurality of light, small interengaging panels of particular configuration and structure whereby the form is easier and faster to assemble than those known in the art because most of the forms are already provided with supports for neighbouring forms. The majority of the panels comprise means for supporting an adjacent panel whereby it is possible to build up a "chess-board array" extending over an enclosure and thereby defining a flat continuous moulding surface.

In use, and once the walls of an enclosure have been erected, or once the forms for such walls have been assembled, a panel of the form of the present invention is rested on means mounted to that effect on the walls or vertical forms defining the enclosure, whereafter a multiplicity of other panels are positioned one at a time in scale fashion over all the surface of the enclosure.

The first panel is positioned in one corner of the enclosure and the form is completed by adding the remaining panels until the diagonally opposite corner of the enclosure is reached. Each panel will rest on previously positioned panels, or, on a previously positioned panel and on the means mounted to that effect on the wall or vertical form defining the enclosure.

Although I have said that the form is assembled by positioning the first panel in the corner of an enclosure and resting it on means secured to that effect to the walls or the forms thereof, I have found it possible to place the first panel in any other position although in such case it is necessary to carefully determine such position so that the remaining panels cover the rest of the enclosure. Additionally it is necessary to provide further supports for the first panel because only the means on the walls or the vertical forms adjacent each corner of the enclosure can afford per se a stable support for a panel of the form of the present invention.

In essence, the present invention provides a form for slabs and the like, for moulding a roof or intermediate floor slab for a substantially rectangular enclosure, the form comprising a plurality of substantially rectangular panels each defining a flat substantially rectangular moulding surface, the panels being arranged in chess-board array to define a substantially flat continuous moulding surface extending over said enclosure, said plurality of panels comprise a first edge-panel and a series of panels, some of which are also edge-panels, said first panel has at least one edge rested against means defining said enclosure and supported by support means secured thereto, the edges of this first panel which do not rest against said means comprise means for supporting a corresponding edge of the panel, of said series of panels, which is positioned adjacent to said first panel, all but one of the panels of this series of panels have means on at least one of their edges to support an adjacent panel and the edge panels of said series of panels have at least one of their edges supported by the support means secured to the means defining the enclosure; each panel which is provided with support means along two adjacent edges also comprises means for receiving a strut, these means being formed in a corner defined by said adjacent edges.

BRIEF DESCRIPTION OF THE DRAWINGS

In order to facilitate the best comprehension of the present invention, specific preferred embodiments will now be described with reference to the accompanying drawings, wherein:

FIG. 1 is a plan view of the new form for a roof slab, assembled in position with regard to the walls of an enclosure.

FIG. 2 shows a vertical section taken along axis 2—2 in FIG. 1.

FIG. 3 shows a partial vertical section along axis 3—3 in FIG. 1.

FIG. 4 is a plan view of one of the panels of the form of the present invention and of part of two adjacent panels.

FIG. 5 shows a section along axis 5—5 in FIG. 4.

FIG. 6 is a plan view of one of the panels of the present invention and of part of four adjacent panels wherein the panels are shaped to provide a decorated ceiling.

FIG. 7 shows a partial section along axis 7—7 in FIG. 6.

FIG. 8 shows a vertical section, similar to that of FIG. 2, but of an alternative embodiment wherein the form of the present invention is rested on the form used to mould the walls of the enclosure whereby the walls and the roof slab or intermediate floor slab can be moulded simultaneously.

DESCRIPTION OF THE PREFERRED EMBODIMENTS

From the drawings it will be seen that the enclosure to be roofed is laterally defined by walls 1 and a previously levelled floor 2.

The form of the present invention comprises a plurality of panels 3, $3^{I}$, $3^{II}$, $3^{III}$, $3^{IV}$, $3^{V}$, $3^{VI}$, $3^{VII}$; 4, $4^{I}$, $4^{II}$, $4^{III}$, $4^{IV}$, $4^{V}$ and 5 each having an upper flat substantially rectangular moulding surface S. These panels are arranged in chess-board array so that the sum of surfaces S defines a substantially flat continuous moulding surface extending over said enclosure.

The panels of the form of the present invention are of three different types: A first type, corresponding to the group of panels identified by reference number 3; a second type, corresponding to the group of panels identified by reference number 4; and a third type, corresponding to the panel identified by reference number 5.

The panels of the first type, that is to say, those identified with reference number 3, comprise a flat rectangular upper plate 6 having surface S defined thereon. Perpendicularly to upper plate 6 panel 3 has four lateral walls 7, $7^{I}$, $7^{II}$, $7^{III}$ which extend downwardly therefrom and which define an edge of the panel. Walls $7^{I}$ and $7^{II}$ have at their lower end an upturned lip 8 thereby defining a channel $8^{I}$ adapted to receive the lateral wall of an adjacent placed panel. The lower edge of walls 7 and $7^{III}$ are upturned to provide a reinforcing member 9. So as to define a continuous and smooth moulding surface, each panel 3 has two lateral walls 7 and $7^{III}$ which are of less height than lateral walls $7^{I}$ and $7^{II}$. This feature can be seen in FIG. 5 which shows a panel $3^{III}$ and a portion of a panel $3^{II}$ connected together so that lateral walls 7 and $7^{II}$ abut one against the other and with lateral wall 7 and reinforcing member 9 mounted within channel $8^{I}$ defined by lateral wall $7^{II}$ and upturned lip 8. To this effect the combined thickness of each of walls $7^{I}$ and $7^{II}$ and reinforcing member 9 is just sufficient for each wall $7^{I}$ and $7^{II}$ with its reinforcing member 9 to fit into channel $8^{I}$.

Each panel of the first type is provided with a strut receiving tube shaped member 11 secured to panel 3, such as by welding, at the corner thereof defined by the two walls or edges $7^{I}$, $7^{II}$ of the panel which are provided with lip-channel member 8-$8^{I}$.

Preferably each strut used with each of the panels 3 of the form of the present invention comprises a pipe 12 provided with vertically spaced slots 13 extending therethrough and into which pegs or wedges 14 can be inserted whereby the lower end of each tube member 11 will rest on each of these pegs or wedges 14 thereby sustaining panels 3 at a predetermined distance from the floor 2 on which the lower end of pipe 12 is made to rest. The lower end of pipe 12 is provided with a foot as shown in FIG. 5.

According to the distance between the floor 2, and the desired position of panel 3, the operator can select the appropriate slot into which the peg or wedge 14 is to be inserted so as to obtain the desired height for the slab to be moulded.

So as to give structural stability to the multiple struts, once they are erected, chains 17 are provided. These chains extend between adjacent struts and are connected to each strut by a bushing 15 which surrounds each strut and is secured thereto at a point approximately equidistant from its ends. Each bushing has four equidistant circumferentially spaced hooks 16 onto each of which one end of a chain can be hooked. These chains 17 extend from strut to strut, parallel to the walls of the enclosure, thereby forming a lattice. At their outer ends, chains 17 are secured to walls 1 by a fastening arrangement 18 such as a hook with a screw threaded shaft adapted to extend through wall 1 and have a nut screwed onto its outer end. Obviously the length of each chain is determined by the dimensions of panels 3, 4 and 5.

The panels of the second type, that is to say those identified with reference number 4, also comprise a flat rectangular upper plate 26 having surface S defined thereon. Perpendicularly to upper plate 26 panel 4 has four lateral walls 27, $27^{I}$, $27^{II}$ and $27^{III}$. These four lateral walls extend downwardly from plate 26 and define the edges of panel 4. Wall $27^{II}$ has at its lower end an upturned lip 28 thereby defining a channel (not identified so as not to confuse FIG. 3 but similar to channel $8^{I}$) adapted to tightly receive the lateral wall of an adjacently placed panel. The lower edge of the other three walls 27, $27^{I}$ and $27^{III}$ are upturned to provide a reinforcing member 29. So as to define a continuous and smooth moulding surface, each panel 4 has three lateral walls 27, $27^{I}$ and $27^{III}$, which are of less height than lateral wall $27^{II}$. Walls 27, $27^{I}$ and $27^{III}$ are of the same height as walls 7 and $7^{III}$ of panel 3 while wall $27^{II}$ is of the same height as walls $7^{I}$ and $7^{II}$ of panel 3. This feature can be seen in FIG. 2 upper right hand corner. In this portion of FIG. 2 it can be seen how wall $27^{I}$ and its reinforcing member 29 of panel $4^{IV}$ abut against wall $7^{II}$ and fit within one of channels $8^{I}$ of panel $3^{VI}$.

In panels 4, the combined thickness of each wall 27, $27^{I}$ and $27^{III}$ and reinforcing member 29 is just sufficient for them to fit tightly into the channels of panels 3 or 4.

Only one of panels 3 and of panels 4 have been described because all the panels of the same type are identical.

The only panel of the third type, that is to say the one identified with reference number 5, also comprises a flat rectangular upper plate 36 (FIG. 3) having surface S defined thereon. Perpendicularly to upper plate 26 panel 5 has four lateral walls 37, $37^{I}$, $37^{II}$ (the fourth lateral wall is not seen in the drawings, but its position is obvious inasmuch as it is similar to walls $7^{III}$ and $27^{III}$ of panels 3 and 4). These four lateral walls extend downwardly from plate 36 and define the edges of panel 5. The lower edge of these four lateral walls 37, $37^{I}$, $37^{II}$ and the one not shown are upturned to provide a reinforcing member 39. So as to define a continuous and smooth moulding surface, each panel 5 has its four lateral walls of the same height as the lateral walls 7 and $7^{III}$ of panel 3 and lateral walls 27, $27^{I}$ and $27^{III}$ of panel 4. This is generally shown in FIG. 3, upper right hand corner where it can be seen how wall 37 and its reinforcing member 39 of panel 5 abut against wall $27^{II}$ of panel $4^{III}$ and fit tightly within the channel of this panel.

In panel 5, the combined thickness of each of its walls and their reinforcing members 39 is just sufficient for them to fit tightly into the channels of panels 3 and 4. The arrangement of parts of the present invention for the assembly of a form also comprises supporting means adapted to be secured to walls 1 for peripherically supporting the over-all moulding form as will be described now in more detail.

These supporting means comprise a plurality of "L" shaped members 40 comprising a first arm $40^{I}$ and a second arm $40^{II}$ defining a slightly obtuse angle therebetween. First arm $40^{I}$ has a bushing 41 secured thereto. Additionally a further "L" shaped member 42 having an additional arm $42^{I}$ is provided for closing the peripherical supporting means.

To assemble the form of the present invention a plurality of pins 43 are secured, at predetermined intervals and all at the same level, to the walls 1 of the enclosure to be roofed. These pins 43 must project inwardly from walls 1 so as to be able to receive bushings 41. To this effect these pins 43 and bushings 41 are dimensioned so that each bushing can be slid over a pin to thereby retain each one of "L" shaped members 40 in the position shown in FIG. 3. The excentric position of bushing 41 causes each "L" shaped member 40 to "fall" to the right until the end of arm $40^{II}$ rests against an adjacent "L" shaped member. If members 40 are mounted consecutively around the enclosure on its four walls 1, arms $40^{II}$ will form a horizontal ridge on which the outer edges of the form can be made to rest. This ridge is closed by arm $42^{I}$ of member 42.

Once this supporting means is secured to walls 1, panel 3 is positioned in one corner of the enclosure (FIG. 1) with its walls 7 and $7^{III}$ resting on arms $40^{II}$. Due to the different heights of the lateral walls of the panels, shims $43^{I}$ (FIGS. 2 and 3) are positioned on arms $40^{II}$ where necessary.

To assure that panel 3 will serve as a stable support for its adjacent panels $3^{I}$ and $3^{II}$, a first strut 44 will be erected as already explained.

Once panel 3 is in position, panel $3^{I}$ will be positioned adjacent panel 3, in scale like manner by fitting wall $7^{III}$ against wall $7^{I}$ with reinforcing member 9 within channel $8^{I}$ and by resting wall 7 on arms $40^{II}$. Likewise panel $3^{II}$ will be positioned adjacent panel 3, in scale like manner by fitting wall 7 against wall $7^{II}$ with reinforcing member 9 within channel $8^{I}$ and by resting wall $7^{III}$ on arms $40^{II}$. On both occasions a new strut will be erected.

Similarly the remainder of panels $3^{III}$, $3^{IV}$, $3^{V}$, $3^{VI}$ and $3^{VII}$ will be assembled. Once this has been done, panel 4 will be place in position with walls 27 and $27^{I}$ resting on arms $40^{II}$ while wall $27^{III}$ and its reinforcing member 29 will be fit into channel $8^{I}$ of panel $3^{I}$. Once this is done panel $4^{I}$ is placed in position by resting wall $27^{I}$ on arms $40^{II}$ while walls 27 and $27^{III}$ and their reinforcing members 29 will be fit into the channel of panel 4 and into the channel $8^{I}$ of panel $3^{III}$ respectively. The remaining panels $4^{II}$, $4^{III}$, $4^{IV}$ and $4^{V}$ will be positioned in like manner.

Panel 5 will be placed in position by merely resting two of its lateral walls $37^{I}$ and $37^{II}$ on arms $40^{II}$ and by fitting its other two walls 37 and the one not shown and their reinforcing members 39 with the channels of panels $4^{III}$ and $4^{V}$.

Consequently each channel of panels 3 and 4 defines support means, protruding from their edges, for an adjacently positioned panel.

Once the panels are positioned, struts 12 are secured in position by chains 17 whereby the form is ready for use, and the cement can be poured onto surfaces S.

When the cement has set, the form is disassembled by removing chain 17, withdrawing wedges 14 and then struts 12, and by taking down supporting means 40, 41, 42, 43. Panels 3, $3^{I}$, $3^{II}$, $3^{III}$, $3^{IV}$, $3^{V}$, $3^{VI}$, $3^{VII}$, 4, $4^{I}$, $4^{II}$, $4^{III}$, $4^{IV}$, $4^{V}$ and 5 are taken down by first lowering panel 3 and then the remaining panels in the order they were assembled. Reference will now be made to FIGS. 6 and 7 which show details of panels having a surface adapted to provide a decorated ceiling. These figures will not be described in detail because of their striking similarity with the panels already described. The only basic difference between the panels of FIGS. 6 and 7 and those of FIGS. 2, 3, 4 and 5 is that they are provided with an inclined edge forming cement receiving channels 50. For an easier identification of the parts of these panels which are similar to those already described, reference numbers have been inserted in FIGS. 6 and 7 which correspond to the description of FIGS. 1 to 5 which is applicable to the embodiment of FIGS. 6 and 7.

Obviously panels 3, 4 and 5 can be provided with any desired shape for obtaining ornamental ceilings.

So as to facilitate disassembly of the panels of FIGS. 6 and 7 a nozzle 51 can be provided so that a source of compressed air can be connected thereto as is well known in this art.

Reference will now be made to FIG. 8 which shows the manner in which the present invention can be used for simultaneously casting walls and a roof. In this case, the form of the present invention is rested on inner form members 100 which together with outer form members 101 serve to define a moulding space 102 for the cement of the future walls of the enclosure.

Support means 103 are secured to inner form members 100 to which effect the upper edge of inner form members 100 is chamferred at 104 and support means 103 are provided with a similar configuration. Inner form members 100 and support means 103 are secured together by bolts 105.

As shown in FIG. 8, the total height of outer form members 101 is greater than the total height of inner form members 100, support means 103 and the form of the present invention, thereby defining the level L up to which the cement will be retained between outer form members 101. The form of the present invention, in this embodiment, also comprises panels 3, 4 and 5 identical to the panels of the previous embodiment and therefore they will not be described in detail. However, for easy identification reference numbers 3, $3^{II}$, $3^{IV}$, $3^{VI}$, and $4^{IV}$ have been inserted in FIG. 8.

In the embodiment being described, the form rests directly on support means 103. Shims 106 are provided to compensate the difference in height between the various lateral walls of the panels. If desired, means can be provided so as to avoid any horizontal movement between the panels and support means 103.

The assembly of this form will not be described in detail because of its similarity with the assembly of the first embodiment described. However, it is to be noted that in order to disassemble the form, once the cement in the moulding space 102 is firm, it is necessary to loosen bolts 105 so that inner form members 100 and thereafter support means 103 can be taken down in that order.

In the embodiment of FIG. 8, it may be particularly important for the peripheral wall of the over-all form to resist lateral forces acting thereon in the direction of arrows A. Consequently, the walls of each panel are of sufficient strength to resist these forces.

When reference is made to an "intermediate roof slab" I have in mind the horizontal slabs which in a multiple storey building separate one storey from another.

Although it has been stated that the assembly of the form of the present invention is initiated by placing the first panel in the corner of an enclosure, or in any other position thereof, it is possible to simultaneously initiate the assembly of the form of the present invention at two spaced apart positions, such as two corners of the enclosure. In such an event two series of panels will be formed. Along the line at which both series of panels will meet, the panels of one series which are positioned along that line will incorporate support means onto which adjacent panels of the other series will be rested.

It will be understood that improvements and modifications may be introduced in the embodiments described by way of example, without departing from the scope of the invention specifically defined in the following claims.

I claim:

1. A form for slabs and the like, for moulding a roof or intermediate floor slab for a substantially rectangular enclosure, the form comprising a plurality of substantially rectangular panels each defining a substantially rectangular moulding surface, the panels being arranged in chess-board array to define a moulding surface adapted to extend over said enclosure, said plurality of panels comprising a first edge-panel and a series of panels, some of which are also edge-panels, said edge-panels being those which are positionable along an edge of said enclosure, said first edge-panel having at least one edge adapted to be rested against means defining said enclosure and supported by support means secured to said means defining said enclosure, the edges of this first edge-panel which are not adapted to rest against said means defining said enclosure comprising means for supporting a corresponding edge of the panels of said series of panels, which are to be positioned adjacent to said first edge-panel, all but one of the panels of this series of panels having means on either one or two of their edges to support an adjacent panel, and the edge-panels of said series of panels having at least one of their edges adapted to be supported by the support means secured to the means defining the enclosure; each panel which is provided with means to support an adjacent panel along two adjacent edges also comprising means for receiving a strut, these strut receiving means being formed in a corner defined by said adjacent edges, and a plurality of struts each supporting one of said panels which have strut receiving means.

2. A form as claimed in claim 1, wherein each panel further comprises, at its edges, means for resisting lateral forces exerted thereon.

3. A set of parts for the assembly of a form for moulding a roof or intermediate floor slab for a substantially rectangular enclosure defined by four lateral surfaces, the arrangement comprising a first group of substantially rectangular panels, a second group of substantially rectangular panels, and one third substantially rectangular panel, each panel having four edges and each panel defining a moulding surface; support means protruding from each of only two adjacent edges of the panels of the first group and from only one edge of the panels of the second group, said third panel having no such support means, said support means each being arranged to support a panel edge which is not provided with said support means when these last two mentioned edges are positioned one against another to thereby define a moulding surface; and means adapted to be secured to said lateral surfaces for supporting at least one panel edge of the panels of said first and second groups which are to be positioned adjacent said lateral surfaces and which are not provided with protruding support means, and for supporting two edges of said third panel; each of said panels of the first group further comprising means for receiving a strut, these strut receiving means being formed in a corner defined by said adjacent edges and a plurality of struts each for supporting one of said panels which have strut receiving means.

4. A set of parts as defined in claim 3, wherein each panel further comprises, at its edges, means for resisting lateral forces exerted thereon.

5. A set of parts as defined in claim 3, wherein said support means which protrude from each panel of the first and second groups comprise an upturned lip which extends along an edge of the panel and a channel defined between said lip and its corresponding edge.

6. A set of parts as defined in claim 5, wherein said panel edges which are are not provided with support means comprise a reinforcing member adapted to be tightly received within said channel.

7. A set of parts as defined in claim 3, wherein said means for receiving a strut is a tube and said strut is of adjustable length.

8. A set of parts as defined in claim 3, wherein the lateral surfaces defining the enclosure are the walls thereof.

9. A set of parts as defined in claim 3, wherein the lateral surfaces defining the enclosure are forms for casting the walls of the enclosure.

* * * * *